United States Patent [19]

Baumann et al.

[11] Patent Number: 4,657,957

[45] Date of Patent: Apr. 14, 1987

[54] BINDING AGENT AQUEOUS DISPERSIONS HAVING IMPROVED COAGULATION PROPERTIES

[75] Inventors: Hans-Peter Baumann, Allschwil; Marcel Grossmann, Reinach, both of Switzerland

[73] Assignee: Sandoz Ltd., Basel, Switzerland

[21] Appl. No.: 819,182

[22] Filed: Jan. 15, 1986

Related U.S. Application Data

[63] Continuation of Ser. No. 767,922, Aug. 21, 1985, abandoned, which is a continuation of Ser. No. 386,007, Jun. 7, 1982, abandoned, which is a continuation of Ser. No. 96,985, Nov. 23, 1979, abandoned, which is a continuation of Ser. No. 904,740, May 11, 1978, abandoned, which is a continuation of Ser. No. 605,776, Aug. 18, 1975, abandoned, which is a continuation-in-part of Ser. No. 454,071, Mar. 25, 1974, abandoned.

[30] Foreign Application Priority Data

Mar. 30, 1973 [CH] Switzerland ..... 4600/73

[51] Int. Cl.[4] ..... C08L 75/04

[52] U.S. Cl. ..... 524/245; 524/169; 524/190; 524/555; 524/560; 524/563; 524/565; 524/567; 524/568; 524/571; 524/577; 524/579; 524/591; 524/598; 528/492

[58] Field of Search ..... 524/598, 245, 555, 560, 524/563, 565, 567, 568, 571, 577, 579, 591; 528/492

[56] References Cited

U.S. PATENT DOCUMENTS

| | | | |
|---|---|---|---|
| 2,809,159 | 10/1957 | Welles et al. | 252/8.8 |
| 2,912,349 | 11/1959 | Videen et al. | 427/369 |
| 2,912,350 | 11/1959 | Videen et al. | 427/369 |
| 3,627,475 | 12/1971 | Baumann et al. | 8/54 |
| 3,660,324 | 5/1972 | Onchi | 260/17.5 |

*Primary Examiner*—Theodore E. Pertilla

*Attorney, Agent, or Firm*—Gerald D. Sharkin; Richard E. Vila; Thomas C. Doyle

[57] ABSTRACT

A method of regulating the coagulation characteristics of a binding agent aqueous dispersion which comprises adding thereto a compound of the formula

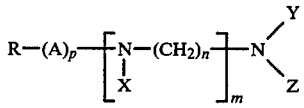

in which

R is an unsubstituted or hydroxy substituted alkyl or alkenyl radical,

A is —O—$CH_2$—$CH_2$— or —O—$CH_2$—CHOH—$CH_2$—, p is zero or 1,

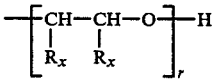

wherein r is an integer and both $R_x$'s are hydrogen or one is a methyl or an ethyl radical and the other is a hydrogen atom, Y and Z are, independently, R—$(A)_p$—, as defined above, or a group as represented by but independent of X, m is zero or an integer 1 to 5, and n is an integer 2 to 6, the compound containing at least one group of the type represented by X, and being in free base, acid addition salt or quaternary ammonium salt form.

Such modified binder dispersions are advantageous for the production of non-woven fabrics. The presence of such a compound in a non-woven fibrous web also reduces the migration of a dye, which may also have been incorporated in the web, during the heating stage of the process.

18 Claims, No Drawings

BINDING AGENT AQUEOUS DISPERSIONS HAVING IMPROVED COAGULATION PROPERTIES

This is a continuation of application Ser. No. 767,922, filed Aug. 21, 1985, now abandoned, which in turn is a continuation of application Ser. No. 386,007, filed June 7, 1982, now abandoned, which in turn is a continuation of application Ser. No. 096,985, filed Nov. 23, 1979, now abandoned, which in turn is a continuation of application Ser. No. 904,740, filed May 11, 1978, now abandoned, which in turn is a continuation of application Ser. No. 605,776, filed Aug. 18, 1975, now abandoned, which in turn is a continuation-in-part of Ser. No. 454,071, filed Mar. 25, 1974, now abandoned.

The present invention relates to a process for improving the coagulation characteristics of aqueous dispersions of binding agents.

More particularly, it relates to a process for producing non-woven fabrics by impregnating a non-woven fibrous web with a binding agent dispersion, and more specifically to the inhibition of migration of the binding agent to the surface of the web on drying the impregnated web in the production of the non-woven fabric.

The bonding of single fibres for the production of non-woven fabrics is generally effected with binding agents which usually are polymer dispersions, e.g. those based on acrylonitrile or acrylic alkyl esters. However, during the drying process of the fibrous web the binding agents have the undesirable tendency to migrate to the surface of the non-woven fabric. Thus, for example, the physical properties and the smoothness of the non-woven fabric are influenced adversely.

Due to the unhomogeneous distribution of the binding agent the internal solidity of the non-woven fabric is insufficient and thus a shifting of fibres and a separation of the fibrous web into various layers occurs. A change in properties results, e.g. a harder feel on the side to which the binding agent migrates, a reduction of the abrasion resistance, and a stronger pilling formation on the other side, a difference in colour shade between the two sides or a surface patchiness when using binding agent dispersions containing a dye, and an inferior fastness to washing and purification.

The above discussed problem is due at least in part, to the fact that commercially available binding agent dispersions are sold in the form of concentrated aqueous dispersions which contain a large amount of ionic dispersing agent. When these dispersions are used in a diluted condition, the previously applied dispersing agent, which is now present in excess, prevents the binding agent from coagulating at the desired temperature.

It is known that this problem can be partially overcome by adding to the binding agent dispersion, when it is being used, certain surfactants of ionic type opposite to that of the dispersing agent already present. It has been found, however, that in practice this simple expedient does not solve all the problems. If enough surfactant is added to neutralize the dispersing agent, then the binding agent tends to coagulate almost immediately at room temperature, i.e. prematurely. On the other hand, if less than a neutralizing amount of the surfactant is added, so that the zeta potential is outside the range ±20 the binding agent dispersion may not coagulate even at elevated temperatures. Also, if the binding agent is applied to the substrate by a process which subjects the binding agent dispersion to significant mechanical forces, as with the use of rollers, this also may cause the binding agent to coagulate prematurely. These problems are believed to be due to the fact that the stabilization of such binding agent dispersions is primarily dependent on ionization factors which must be very carefully adjusted. This need for careful adjustment is, in itself, a disadvantage when operating under industrial conditions.

Accordingly, the present invention provides an improved method for regulating the coagulation characteristics of a binding agent aqueous dispersion which comprises adding thereto a compound of formula (I),

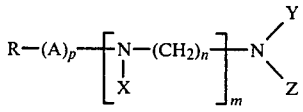

(I)

in which

R is a $C_{10-24}$ alkyl or a $C_{10-24}$ alkenyl radical which is unsubstituted or hydroxy substituted;

A is $—O—CH_2—CH_2—$ or $—O—CH_2—CHOH.CH_2—$;

p is zero or 1;

X is

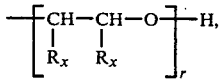

wherein r is an integer 1 to 198; and either both $R_x$'s are simultaneously hydrogen atoms, or one $R_x$ is a methyl or an ethyl radical and the other is a hydrogen atom;

Y is

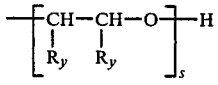

or $R—(A)_p—$, wherein s is an integer 1 to 198;

either both $R_y$'s are simultaneously hydrogen atoms, or one $R_y$ is a methyl or an ethyl radical and the other is a hydrogen atom; and R, A and p are as defined above;

Z is

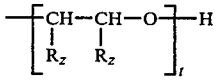

or $R—(A)_p—$, wherein t is an integer 1 to 198;

either both $R_z$'s are simultaneously hydrogen atoms or one $R_z$ is a methyl or an ethyl radical and the other is a hydrogen atom; and R, A and p are as defined above;

m is zero or an integer 1 to 5; and n is an integer 2 to 6;

with the provisos that the compound contains at least one group

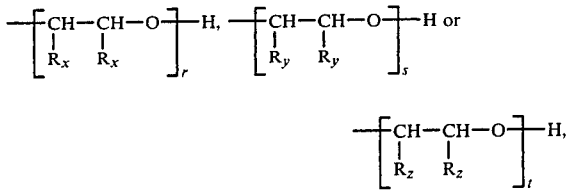

and that the sum of r, s and t does not exceed 200 and is preferably in the range 15 to 100; in free base, acid addition salt or quaternary ammonium salt form.

In the above definition of formula (I), it is to be understood that each unit

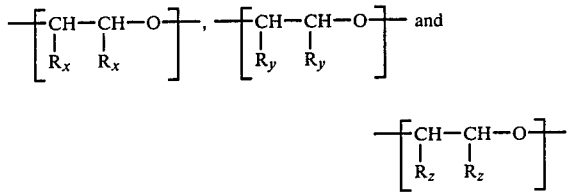

in X, Y and Z, respectively, is to be treated independently with respect to the definition of the two $R_x$'s, $R_y$'s and $R_z$'s when more than one of such units are present in X, Y or Z.

The present invention also provides an improved method for producing a non-woven fabric which comprises impregnating a non-woven fibrous web with a binding agent aqueous dispersion and a compound of formula (I) and heating the impregnated web to cause coagulation of the binding agent and to effect drying.

It has been found that in the presence of a compound of formula (I), a binding agent dispersion has a controllable sensitivity and upon heating a non-woven fibrous web impregnated in accordance with the method of the invention, the binding agent breaks away from the dispersion and coagulates with the migration inhibitor of formula (I) to form a highly viscous or semi-solid immobile mass which tends not to migrate to the surface of the fibrous web during drying thereof. The coagulation occurs almost instantaneously as soon as a limiting temperature is attained, the limiting temperature being dependent on such factors as the pH of the dispersion and the concentrations of the binding agent and migration inhibitor of formula (I) and thus being variable. In general, the limiting temperature lies in the range 25° to 200° C., preferably 30° to 150° C. and more preferably 40° to 100° C.

The exact mechanism by which the migration inhibitor operates is uncertain, although it is believed to operate by virtue of the combination of an electrical interaction between the migration inhibitor of formula (I) and the binding agent dispersion and the inverse solubility of the migration inhibitor which causes it to precipitate once the limiting temperature has been reached, taking with it the binding agent. Thus, it is believed that the migration inhibitor neutralizes or partially neutralizes the effect of the dispersion agent already in the binder dispersion, but prevents the binder from coagulating prematurely by virtue of its own dispersing properties which are effective as long as the temperature is maintained below the limiting temperature. Because a dispersing effect as well as an ionization effect is present, the resulting compositions have good stability and critical manipulation of all variables is not necessary.

The limiting temperature can be readily determined for any combination of binder and compound of formula (I) by the following procedure:

A quantity of binding agent dispersion is diluted with water to a suitable concentration and an equal amount of the diluted dispersion is placed in each of three beakers. An equal amount of the compound of formula (I) is added to each beaker to give a content of about 10% by weight based on the weight of binding agent solids. The pH's of the three test samples are adjusted to 4, 6 and 8 respectively. (If a more precise determination is desired, more beakers can be employed and a larger number of different pH's tested). The beakers are then heated and the temperature noted when the content of each beaker coagulates. The samples coagulating at the lowest temperature indicates the most favorable pH. Three more beakers (or more if a more precise determination is desired) are again filled with equal amounts of the diluted binding agent dispersion. To each is added a different amount of compound of formula (I) to give concentrations of, e.g. 5%, 10% and 20%. The pH of all samples are adjusted to that which was found to be most favorable and the samples are heated until coagulation occurs. The sample coagulating at the lowest or most appropriate temperature for the intended use, indicates the concentration of migration inhibitor that should be used at the pH which had already been determined.

The present invention can be employed depending on the particular binding agent dispersion, over a pH range of 1 to about 8, although for many substrates it is advisable to maintain the pH in the range 4 to 8. The preferred range is 4 to 6.

It has further been found that the compounds of formula (I) substantially reduce the migration of dyes incorporated in non-woven fibrous webs during the drying thereof, if the dye is first incorporated in the binding agent aqeuous dispersion prior to the impregnation of the non-woven fibrous web with the latter and a compound of formula (I) according to the process of the invention. The use of a compound of formula (I) according to the process together with a dye thus not only substantially reduces the migration of the binding agent through the fibres in the web but also has the same effect on the incorporated dye, with the result that the non-woven fabric produced after the heating and drying stage in the process is rendered more evenly coloured through the more even dye penetration of the web. Accordingly, a further feature of the present invention is the aforedescribed process, in which the binding agent aqueous dispersion contains a dye.

Binding agent aqueous dispersions which can be modified in accordance with the present invention are, in general, polymer dispersions. However, it is also contemplated that improved coagulating properties can be imparted to dispersions of rubber, such as are used in the molding of rubber gloves, and it is to be understood that the terms "binding agent" and "binder", as used herein, include such rubber dispersions.

Examples of appropriate binding agents that may be mentioned are homo- and copolymers of butadiene, styrene, acrylonitrile, isobutylene, vinyl esters such as vinyl acetate and propionate, vinyl halides, vinylidene chloride, acrylic esters such as methyl and butyl acrylate, methacrylic esters, methylene-bisacrylic amide, (methyl)-acrylic amide together with their emulsion polymerization catalysts, and dimethylol urea, dimethylol propylene urea, dimethylol melamine, dimethylol methylcarbamate together with the cross-linking catalysts thereof.

The structural formulae of dispersion agents which are present in commercially available binding agent aqueous dispersions are, generally, not released by the manufacturers. Examples of binding agent aqueous dispersions, useable in the process of the invention, which are commercially available and inevitably include a dispersion agent are the following products, identified by their trade names and manufacturers:

Perbunan N Latex 3415M, manufactured by an available from Bayer A.G., Leverkusen, West Germany.

Primal HA-8, manufactured by and available from Rohm and Haas Inc., Philadelphia, U.S.A.

Hycar 1570 H36, manufactured by and available from A.K.U.-Goodrich, Arnhem, Holland.

The process of the present invention, because of the cationic nature of the compounds of formula (I), is most suitable for use with binders which have been stabilized with an anionic dispersing agent. However, it has also been employed with binders which are said to be stabilized with a non-ionic dispersing agent. It is believed that in such instances the binder itself has an anionic character which is affected by the addition of the migration inhibitor.

The nature of the non-woven fibrous web material employed in the process of the invention has been found to have little effect on the migration inhibiting properties of the compounds of formula (I).

Examples of typical non-woven natural and synthetic raw materials for the process are cotton, wood fibers, jute, sisal, wool, silk, viscose, polyamide, polyacrylonitrile, polyester and polypropylene and mixtures thereof.

The production of the impregnation bath is generally effected in manner known per se, e.g. by mixing the various components. Increased solubility of the migration inhibitors of formula (I) in water is obtained by using the compounds in quaternary ammonium salt or acid salt form. If the production of coloured non-woven fabrics is required, dyestuffs, e.g. pigmented dyestuffs, may be added to the impregnation bath. A suitable amount of migration inhibitor in the bath is, for example, 1 to 50, preferably 1 to 25, most preferably 5 to 25 parts per 100 parts of binding agent solid by weight.

Impregnation of the non-woven fibrous web with the migration inhibitor of formula (I) and with the binding agent aqueous dispersion are preferably effected simultaneously, i.e. the migration inhibitor is mixed with the binding agent aqueous dispersion prior to the impregnation. Accordingly, the present invention also provides an improved binding agent aqueous dispersion for carrying out the process of the invention, comprising an aqueous dispersion of a binding agent in association with a compound of formula (I). There may also be present in this medium a dye. A suitable amount of the compound of formula (I) in such a dispersion is 1 to 50, and preferably 1 to 25 parts by weight per 100 parts by weight of binding agent solid.

According to the process of the invention, once the impregnation of the fibrous web with the binding agent aqueous dispersion and the compound of formula (I) has been carried out, the web is heated to cause coagulation of the binding agent and to effect drying. The drying is preferably performed at temperatures up to 200° C., more preferably in the range 120° to 160° C.

Another feature of the present invention comprises the non-woven fabrics whenever produced according to the process of the invention.

The compounds of formula (I) employed in the process of the invention and present in the binding agent aqueous dispersions of the invention are generally known. It is to be understood that one or more of such compounds may be used as the migration inhibitor in the process of the invention. Particularly suitable migration inhibitors of formula (I) are those of formula (Ia),

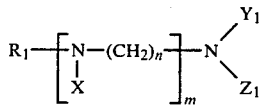

(Ia)

in which $R_1$ is an unsubstituted $C_{10-24}$ alkyl or alkenyl radical;

X is as hereinbefore defined;

$Y_1$ is

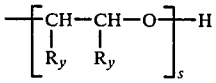

as hereinbefore defined;

$Z_1$ is

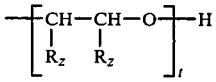

as hereinbefore defined; and m and n are as hereinbefore defined;

More preferred migration inhibitors of formula (Ia) are those in which $R_1$ is an unsubstituted alkyl or alkenyl radical derived from a carbonyl-reduced natural fatty acid containing 10, 12, 14, 16, 18, 20, 22 or 24 carbon atoms, especially such a radical derived from reduced tallow fatty acids, such as the saturated acids lauric ($C_{12}$), myristic ($C_{14}$), palmitic ($C_{16}$), stearic ($C_{18}$) and arachidic ($C_{20}$), the single unsaturated oleic acid ($C_{18}$), and the double unsaturated linoleic acid ($C_{18}$), or from reduced coconut oil acids, such as the saturated capric acid ($C_{10}$) and lauric, myristic, palmitic, stearic, oleic and linoleic acids.

Further preferred migration inhibitors of formula (Ia) are those in which the symbols r, s and t, of the moieties X, $Y_1$ and $Z_1$ are each greater than 1, and in particular their sum being 15 to 100 , m is 1 and n is 2 or 3.

Especially preferred migration inhibitors of formula (Ia) are those of formula (Ib),

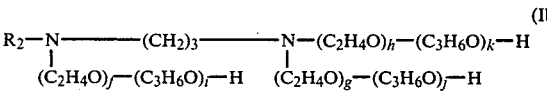

(Ib)

in which $R_2$ is an alkyl or alkenyl radical derived from reduced tallow fatty acids;

each of the groups $-(C_2H_4O)_f-(C_3H_6O)_i-H$, $-(C_2H_4O)_g-(C_3H_6O)_j-H$ and $-(C_2H_4O)_h-(C_3H_6O)_k-H$ contains a mixed chain of ethyleneoxy ($C_2H_4O$) and propyleneoxy ($C_3H_6O$) groups, or contains only units of one kind of group or the other, each propyleneoxy group being present either as —CH(CH$_3$)—CH$_2$—O— or as —CH$_2$—CH(CH$_3$)—O—, and each of the symbols f to k is zero or an integer 1 to 98, with the proviso that f+i, g+j and h+k are each at least 1 and the sum of f to k is 15 to 100, and more preferably 25 to 59.

Of the compounds of formula (Ib), a preferred group is constituted by those in which $R_2$ is as defined above and in which each of the groups —$(C_2H_4O)_f$—$(C_3H_6O)_i$—H, —$(C_2H_4O)_g$—$(C_3H_6O)_j$—H and —$(C_2H_4O)_h$—$(C_3H_6O)_k$—H contains either all ethyleneoxy groups or all propyleneoxy groups or an ordered chain of ethyleneoxy groups followed by propyleneoxy groups or an ordered chain of propyleneoxy groups followed by ethyleneoxy groups, with the proviso that f+g+h is 5 to 40, preferably 6 to 25, and i+j+k is 10 to 60, preferably 10 to 34. Particularly preferred are those compounds in which, more specifically, f+g+h is 12 to 25 and i+j+k is 13 to 34, the most preferred being those in which f+g+h is 21 and i+j+k is 14 or 24, and those in which f+g+h is 14 and i+j+k is 30.

The production of the compounds of formula (I) may be effected by methods known per se, for example by converting the generally known amines of formula (II),

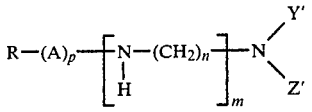

(II)

in which

R, A, m, n and p are as defined above, and

Y' and Z' independently, are hydrogen or R—$(A)_p$, with the proviso that when m is zero, Y' and/or Z' are/is hydrogen, into their glycol derivatives by the addition of ethylene oxide and/or propylene oxide and/or butylene oxide in the presence of catalysts such as alkali hydroxides, at normal or increased pressure and at temperatures of from 100° to 170° C.

In the starting amines of formula (II), preferred alkyl and alkenyl radicals R are those of reduced natural fatty acids of 10, 12, 14, 16, 18, 20, 22 or 24 carbon atoms, but radicals from the reduced fatty acids of 11, 13, 15, 17, 19, 21 and 23 carbon atoms are also appropriate. A mixture of amines of formula (II), wherein R in any component of formula (II) signifies an alkyl or alkenyl radical derived from a reduced natural fatty acid of 10 to 22 carbon atoms is particularly preferred. A suitable mixture of amines of formula (II) for producing corresponding compounds of formula (Ia) is obtained when R in any component amine signifies an alkyl or alkenyl radical of the reduced tallow fatty acids and particularly the saturated acids, e.g. lauric acid ($C_{12}$), myristic acid ($C_{14}$), palmitic acid ($C_{16}$), stearic acid ($C_{18}$), arachidic acid ($C_{20}$); the signal unsaturated acids, e.g. oleic acid ($C_{18}$) and the double unsaturated acids, e.g. linoleic acid ($C_{18}$).

An equally good mixture of amines of formula (II) is obtained when R in any component amine signifies an alkyl or alkenyl radical from the reduced coconut oil acids and particularly the saturated acids, e.g. capric acid ($C_{10}$), lauric acid ($C_{12}$), myristic acid ($C_{14}$), palmitic acid ($C_{16}$), stearic acid ($C_{18}$), and the unsaturated oleic acid ($C_{18}$) and linoleic acid ($C_{18}$).

The amines may be mono- or polyamines, e.g. di-, tri-, tetra-, penta- or hexa-amines, the nitrogen atoms of these amines being bound through alkylene groups of 2, 3, 4, 5 or 6 carbon atoms. Alkylene groups of 2 or 3 carbon atoms are preferred. As examples of amines of formula (II) may be mentioned decyl amine, cocosyl amine, lauryl amine, myristyl amine, palmityl amine, oleyl amine, stearyl amine, arachinyl amine, behenyl amine, lignoceryl amine, tallow amine, N-amino-propyl-cocosyl amine, N-aminoethyl-myristyl amine, N-amino-propyl-myristyl amine, N-aminobutyl-myristyl amine, N-amino-pentyl-myristyl amine, N-aminohexyl-myristyl amine, N-amino-ethyloleyl amine, N-amino-propyloleyl amine, N-aminoethyl-behenyl amine, N-amino-propyl-behenyl amine, N-amino-butyl-behenyl amine, N-aminoethyl-arachinyl amine, N-amino-propyl-arachinyl amine, N-amino-butyl-arachinyl amine N-amino-ethyl-tallow amine, N-amino-propyl-tallow amine, N-amino-cocosyl-dipropylene triamine, N-stearyl-diethylene-triamine, N-stearyl-dipropylene triamine, N-stearyl-triethyl-tetraamine, N-stearyl-pentaethylene-hexaamine, N-myristyl-dipropylene-triamine, N-myristyl-hexamethylene-diamine, N-palmityl-diethylene-triamine, N-palmityl-dipropylene-triamine, N-oleyl-dipropylene-triamine, N-behenyl-dipropylene-triamine, N-arachinyl-diethylene-triamine, N-lignoceryl-diethylene-triamine, N-tallow-dipropylene-triamine, N-tallow-triethylene-tetraamine, N-tallow-tetraethylene-pentaamine, N-tallow-tripropylene-tetraamine and/or the mixtures thereof.

Examples of amines (A) and amine mixtures (AM) of formula (II) are indicated in the form of formulae in Table 1.

TABLE 1

| | | |
|---|---|---|
| AM | 1 | $R_1$—NH—$(CH_2)_3$—NH—$(CH_2)_3$—$NH_2$ |
| AM | 2 | $R_1$—NH—$(CH_2)_3$—NH—$(CH_2)_3$—NH—$(CH_2)_3$—$NH_2$ |
| AM | 3 | $R_2$—NH—$(CH_2)_2$—NH—$(CH_2)_2$—$NH_2$ |
| AM | 4 | $R_1$—NH—$(CH_2)_2$—NH—$(CH_2)_2$—NH—$(CH_2)_2$—$NH_2$ |
| AM | 5 | $R_1$—NH—$(CH_2)_2$—NH—$(CH_2)_2$—NH—$(CH_2)_2$—NH—$(CH_2)_2$—$NH_2$ |
| AM | 6 | $R_1$—NH—$(CH_2)_2$—NH—$(CH_2)_2$—NH—$R_1$ |
| A | 7 | $R_3$—[—NH—$(CH_2)_2$—]—$_5NH_2$ |
| AM | 8 | $R_1$—$NH_2$ |
| AM | 9 | $R_1$—NH—$(CH_2)_3$—$NH_2$ |
| A | 10 | $C_{18}H_{35}$—O—$CH_2$—CHOH—$CH_2$—NH—$(CH_2)_2$—NH—$(CH_2)_2$—$NH_2$. |

In this Table, for each component amine of an amine mixture (AM)
$R_1$ signifies an alkyl or alkenyl radical of a mixture of tallow fatty acids,
$R_2$ signifies an alkyl or alkenyl radical of a mixture of coconut oil acids, and
$R_3$ signifies the cetyl radical.

The amine or amine mixture of formula (II) may be reacted in any desired order with the various alkylene oxides. Thus, for example, the amine or the amine mixture may be reacted first with propylene oxide and subsequently with ethylene oxide or first with ethylene oxide and subsequently with propylene oxide and then optionally again with butylene oxide. The amine or the amine mixture may also be reacted with mixtures of such oxides in the same reaction vessel.

Increased solubility in aqueous systems is obtained by converting the condensation products of formula (I), which contain at least one basic nitrogen atom, by methods known per se into the corresponding quaternary ammonium salt forms with alkylation agents, e.g. dimethyl sulphate, diethyl sulphate, methyl chloride or benzyl chloride. They may also be converted into the corresponding acid addition salt forms with low molecular weight carboxylic acids such as formic acid, acetic acid, propionic acid, lactic acid or oxalic acid, or with inorganic acids such as phosphoric acid, sulphuric acid, chlorosulphuric acid, hydrochloric acid or sulphamic acid.

The composition of compounds of formula (I) according to the reagents used in their preparation is indicated in Table 2.

TABLE 2

| Migration inhibitor | 1 mol of the amine | 1,2-propylene-oxide in mol | ethylene oxide in mol | 1,2-butylene oxide in mol | |
|---|---|---|---|---|---|
| 1 | AM 1 | 24 | 11 | | |
| 2 | AM 1 | 7 | 14 | | |
| 3 | AM 2 | 15 | 21 | | |
| 4 | AM 2 | 79 | 21 | | |
| 5 | AM 2 | 200 | 100 | | |
| 6 | AM 2 | 20 | 10 | 5 | + 1 Mol $HOSO_2Cl$ |
| 7 | AM 2 | 169 | 31 | | |
| 8 | AM 3 | 10 | 12 | | |
| 9 | AM 4 | 15 | 20 | 2 | + 1 Mol $NH_2SO_3H$ |
| 10 | AM 5 | 200 | 100 | | |
| 11 | AM 5 | 8 | 14 | | |
| 12 | AM 6 | 15 | 20 | 1 | |
| 13 | AM 1 | 4 | 4 | | |
| 14 | AM 2 | 4 | 8 | | |
| 15 | AM 3 | 2 | 6 | | |
| 16 | AM 5 | 6 | 14 | | |
| 17 | AM 1 | — | 5 | 2 | |
| 18 | AM 4 | 1 | 5 | 1 | |
| 19 | AM 6 | 2 | 6 | 1 | + 1 Mol $NH_2SO_3H$ |
| 20 | AM 2 | — | 15 | 20 | + 1 Mol $NH_2SO_3H$ |
| 21 | A 7 | 15 | 21 | — | |
| 22 | A 7 | — | 20 | 20 | |
| 23 | AM 8 | 1 | 1 | | |
| 24 | AM 8 | 1 | 1 | 1 | + 1 Mol $NH_2SO_3H$ |
| 25 | AM 9 | 3 | 5 | | |
| 26 | AM 9 | 3 | 15 | | |
| 27 | AM 9 | — | 10 | 5 | |
| 28 | AM 9 | 10 | 5 | 1 | |
| 29 | AM 8 | — | 5 | 3 | |
| 30 | AM 9 | 3 | 10 | 3 | + 1 Mol $H_2SO_4$ |
| 31 | A 10 | 14 | 21 | | |

In the following Examples the parts and percentages are by weight and the temperatures are in degrees Centigrade.

EXAMPLE 1

A mechanically pre-solidified fibre sheet consisting of rayon staple fibre and polyester shrinking fibres, is treated with an impregnation bath which has the following consituents:

| | |
|---|---|
| 309 | parts of an aqueous dispersion which contains 47.5% of butadiene-acrylonitrile binder, commercially available under the trade name Perbunan N Latex 3415 M, (Bayer A) |
| 671 | parts of water, |
| 20 | parts of a migration inhibitor, formula (Ib), wherein f + g + h is 21 and i + j + k is 24. |
| 1000 | parts |

The coagulation temperature of the binding agent aqueous dispersion is 45°. The pH of the impregnation bath is 4.5 and the pick up is 200% based on the dry weight of the sheet.

For the drying of the impregnated non-woven fabric a combination, consisting of infra-red and convection dryers, is used. The thin steam phase produced on both surfaces and in the interior of the non-woven fabric causes a shock-like coagulation of the binding agent on the fibre and thus thermo-migration may be prevented. Drying is completed at 150° in a convection dryer.

Compared with a product treated in the absence of a compound of formula (I), this non-woven fabric has the advantage that the distribution of the binder is homogeneous, no delamination takes place and no hardening of the handle results. Similar results are obtained by using a stabilized polyacrylate instead of a stabilized butadiene-acrylonitrile binder dispersion. The exact composition of the commercial product used cannot be determined.

EXAMPLE 2

A hydrodynamically formed viscose fibre sheet is treated in accordance with Example 1 with an impregnation bath of the following constituents:

| | |
|---|---|
| 138 | parts of an aqueous dispersion which contains 46% of polyacrylate binder, commercially available under the trade name Primal HA-8, (Rohm & Haas) |
| 832.5 | parts of water, |
| 9.5 | parts of C.I. Pigment Yellow I, Colour Index No. 11680, of formula |

-continued

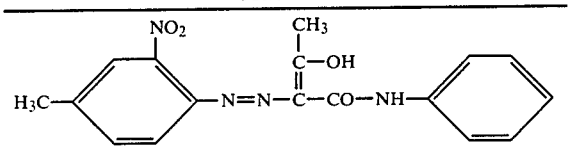

20 parts of a migration inhibitor of formula (Ib), wherein f + g + h is 21 and i + j + k is 14.

1000 parts

The coagulation temperature of the binding agent aqueous dispersion is 63°. The pH of the impregnation bath is 6.0 and the pick up is 100% based on the dry weight of the sheet.

After the impregnation the non-woven fabric is dried on one side in an infra-red field. Without the addition of the migration inhibitor, the binding agents and dyestuffs migrate to the surface presented to the infra-red radiators. The migration is prevented by using the above described impregnation bath.

After processing in accordance with Example 1 the sheet shows further advantages:

no colour two-sidedness, i.e. homogeneous distribution of the dyestuff through the fabric, no undesirable changes in handle, no pilling formation.

EXAMPLE 3

A spinning web consisting of polyester fibre is padded in accordance with Example 1 with a padding bath of the following composition:

120 parts of an aqueous dispersion which contains 40% of carboxilated nitrile Latex which reacts in the heat (commercially available under the trade name Hycar 1570 H36, (A.K.U.-Goodrich)

845.7 parts of water, 16.3 parts of C.I. Pigment Red 5, Colour Index No. 12490, of formula

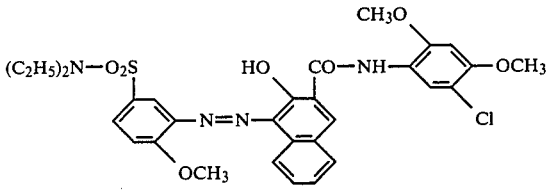

18 parts of a migration inhibitor of formula (Ib), wherein f + g + h is 21 and i + j + k is 54.

1000 parts

The coagulation temperature of the binding agent aqueous dispersion is 41°. The pH of the padding liquor is 6.0 and the pick up is 100% based on the dry weight of the web. The padded non-woven fabric is dried at 150° in a circulating air dryer.

Compared with a product treated in the absence of the compound of formula (I), this fabric has the same advantages as indicated in Examples 1 and 2.

EXAMPLE 4

414 Parts of an aqueous dispersion which contains 46% of polyacrylate-binder, commercially available under the trade name Primal HA-8, are mixed with 50 parts of a 50% aqueous solution of the migration inhibitor of formula (Ib), wherein f+g+h is 21 and i+j+k is 14.

The pH of the concentrated dispersion is 6.65 and the viscosity is 72.1 cp.

For the solidification of the fibrous web the binding agent aqueous dispersion may optionally be diluted and used for impregnation.

What is claimed is:

1. A composition comprising an aqueous dispersion of a binding agent in admixture with a compound or mixture of compounds of formula Ib

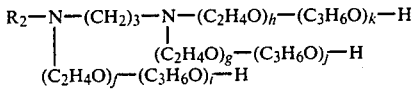

Ib in which $R_2$ is an alkyl or alkenyl radical of 10 to 24 carbon atoms derived from reduced tallow fatty acids;

each of the groups $-(C_2H_4O)_f-(C_3H_6O)_i-H$, $-(C_2H_4O)_g-(C_3H_6O)_j-H$ and $-(C_2H_4O)_h-(C_3H_6O)_k-H$, independently, contains either all ethyleneoxy ($C_2H_4O$) or all propyleneoxy ($C_3H_6O$) groups, or contains an ordered chain of ethyleneoxy groups followed by propyleneoxy groups or an ordered chain of propyleneoxy groups followed by ethyleneoxy groups; each propyleneoxy group is present either as $-CH(CH_3)-CH_2-O-$ or as $-CH_2-CH(CH_3)-O-$; and each of the symbols f to k is zero or an integer, with the provisos that each of f+i, g+j and h+k is at least 1 and f+g+h is 5 to 40 and i+j+k is 10 to 60, said compound(s) of formula Ib being in free base, acid addition salt or quaternary ammonium salt form; and said binding agent comprising rubber or a member selected from the group consisting of homo- and copolymers of butadiene, styrene, acrylonitrile, isobutylene, vinyl esters, vinyl halides, vinylidene chloride, acrylic esters, methacrylic esters, methylene-bis-acrylic amide and (methyl)-acrylic amide, and dimethylol urea, dimethylol propylene urea, dimethylol melamine and dimethylol methylcarbamate.

2. A composition according to claim 1, in which $R_1$ in the formula is an unsubstituted alkyl or alkenyl radical derived from a carbonyl reduced natural fatty acid containing 10, 12, 14, 16, 18, 20, 22 or 24 carbon atoms.

3. A composition according to claim 1, in which f+g+h is 12 to 25 and i+j+k is 13 to 34.

4. A composition according to claim 3, in which f+g+h is 21 and i+j+k is 14 or 24.

5. A composition according to claim 3, in which f+g+h is 14 and i+j+k is 30.

6. A composition according to claim 1, in which 1 to 50 parts by weight of the compound of formula (I) are used per 100 parts by weight of binding agent solid.

7. A composition according to claim 1, containing a dye.

8. A composition according to claim 1 wherein the binding agent aqueous dispersion contains an anionic dispersing agent.

9. In an aqueous dispersion of a binding agent, said dispersion containing a stabilizing amount of an anionic dispersing agent and a sufficient amount of a cationic compound to render said dispersion coagulable at a temperature below a predetermined temperature, the improvement wherein the cationic compound is a compound or mixture of compounds of the formula Ib

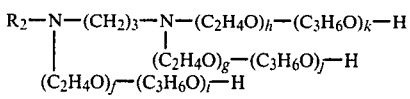

Ib in which $R_2$ is an alkyl or alkenyl radical of 10 to 24 carbon atoms derived from reduced tallow fatty acids;

each of the groups $—(C_2H_4O)_f—(C_3H_6O)_i—H$, $—(C_2H_4O)_g—(C_3H_6O)_j—H$ and $—(C_2H_4O)_h—(C_3H_6O)_k—H$, independently, contains either all ethyleneoxy ($C_2H_4O$) or all propyleneoxy ($C_3H_6O$) groups, or contains an ordered chain of ethyleneoxy groups followed by propyleneoxy groups or an ordered chain of propyleneoxy groups followed by ethyleneoxy groups; each propyleneoxy group is present either as $—CH(CH_3)—CH_2—O—$ or as $—CH_2—CH(CH_3)—O—$; and each of the symbols f to k is zero or an integer, with the provisos that each of f+i, g+j and h+k is at least 1 and f+g+h is 5 to 40 and i+j+k is 10 to 60, said compound(s) of formula Ib being in free base, acid addition salt or quaternary ammonium salt form.

10. A composition according to claim 9 wherein f+g+h is 12 to 25 and i+j+k is 13 to 34.

11. A composition according to claim 3 wherein each of f+i, g+j and h+k is at least 2.

12. A composition according to claim 10 wherein each of f+i, g+j and h+k is at least 2.

13. A composition according to claim 11 wherein the binding agent is a dispersion of an acrylonitrile or acrylic acid ester polymer.

14. A composition according to claim 11 wherein the binding agent aqueous dispersion contains an anionic or non-ionic dispersing agent.

15. A composition according to claim 11 wherein the binding agent aqueous dispersion contains an anionic or non-ionic dispersing agent and the compound of formula (Ib) is present in an amount of 1 to 25 parts per 100 parts of binding agent solid.

16. A composition according to claim 1 wherein, in formula Ib, $R_2$ is an alkyl or alkenyl radical from lauric, myristic, palmitic, stearic, arachidic, oleic or linoleic acid.

17. A composition according to claim 12 wherein, in formula Ib, $R_2$ is an alkyl or alkenyl radical from lauric, myristic, palmitic, stearic, arachic, oleic or linoleic acid.

18. A composition according to claim 15 wherein, in formula Ib, $R_2$ is an alkyl or alkenyl radical from lauric, myristic, palmitic, stearic, arachic, oleic or linoleic acid.

* * * * *